US006326881B1

(12) United States Patent
Dahl

(10) Patent No.: US 6,326,881 B1
(45) Date of Patent: Dec. 4, 2001

(54) ALARM CLOCK SYSTEM

(76) Inventor: Mark V. Dahl, 4513 Willow Oak La., Minnetonka, MN (US) 55343

( * ) Notice: Subject to any disclaimer, the term of this patent is extended or adjusted under 35 U.S.C. 154(b) by 0 days.

(21) Appl. No.: 09/593,436

(22) Filed: Jun. 14, 2000

(51) Int. Cl.[7] ..... G08B 1/00

(52) U.S. Cl. ..... 340/309.15; 340/309.4; 340/309.5; 340/573

(58) Field of Search ..... 340/309.15, 309.4, 340/309.5, 573; 368/10, 71, 73, 76, 82, 251

(56) References Cited

U.S. PATENT DOCUMENTS 4,280,209 * 7/1981 Mooney ..... 368/71
4,385,841 * 5/1983 Kramer ..... 340/309.4
4,487,512 * 12/1984 Price ..... 368/66
5,051,967 * 9/1991 Dismond, III ..... 368/62
5,258,656 * 11/1993 Pawlick ..... 307/141
5,724,021 * 3/1998 Perrone ..... 340/309.15

* cited by examiner

*Primary Examiner*—Jeffery Hofsass
*Assistant Examiner*—Hung Nguyen
(74) *Attorney, Agent, or Firm*—Michael S. Newstel

(57) ABSTRACT

An alarm clock system for facilitating a moment of mindfulness, awareness, stress reduction and quiet at random times during the day. The inventive device includes an encasement, a display positioned within the encasement, a speaker positioned within the encasement, a plurality of control buttons positioned within the encasement, and a control unit positioned within the encasement and electrically connected to the control buttons, display and the speaker. The user may program the control unit using the control buttons as to the frequency of the random alarms, quite times, sound level of alarm and various other settings.

20 Claims, 4 Drawing Sheets

ALARM CLOCK SYSTEM

BACKGROUND OF THE INVENTION

1. Field of the Invention

The present invention relates generally to alarm clocks and more specifically it relates to an alarm clock system for facilitating a moment of mindfulness, awareness, stress reduction and quiet at random times during the day.

Technology has greatly expanded the overall efficiency of today's employees. Arguably one of the greatest technologies invented to assist employee productivity is the modern computer. However, employees that utilize a computer throughout the day typically fail to take the necessary breaks to ensure they are rested and to relax. Extended exposure to a computer monitor can also contribute to various types of vision problems in the work place thereby actually reducing the employee's overall productivity. There is a need for a device that will assist employees and others in randomly becoming aware of a moment in time and to take a needed break.

2. Description of the Prior Art

Alarm clocks have been in use for years. Typically, a conventional alarm clock allows the user to program the clock to sound an alarm at a specific time. Conventional alarm clocks are not designed to randomly sound an alarm for creating a moment of mindfulness, awareness, stress reduction and quite at random times of the day.

Examples of patented clock devices include U.S. Pat. No. 4,659,231 to Barkouki; U.S. Pat. No. 4,906,982 to Gwynn; U.S. Pat. No. 5,097,429 to Wood et al.; U.S. Pat. No. 4,430,005 to Nishimura; U.S. Pat. No. 4,302,752 to Weitzler; U.S. Pat. No. 4,698,783 to Nishimuro et al.; U.S. Pat. No. 5,706,258 to Poe et al.; U.S. Pat. No. 5,511,046 to Vanderpal; U.S. Pat. No. 5,444,673 to Mathurin; U.S. Pat. No. 4,601,584 to DeWolf et al.; U.S. Pat. No. 4,512,667 to Doulton et al.; U.S. Pat. No. 4,276,541 to Inoue et al. which are all illustrative of such prior art.

While these devices may be suitable for the particular purpose to which they address, they are not as suitable for facilitating a moment of mindfulness, awareness, stress reduction and quiet at random times during the day. Conventional clock devices simply do not randomly notify an individual when it is time to become conscious of a moment in time.

In these respects, the alarm clock system according to the present invention substantially departs from the conventional concepts and designs of the prior art, and in so doing provides an apparatus primarily developed for the purpose of facilitating a moment of mindfulness, awareness, stress reduction and quiet at random times during the day.

SUMMARY OF THE INVENTION

In view of the foregoing disadvantages inherent in the known types of clocks now present in the prior art, the present invention provides a new alarm clock system construction wherein the same can be utilized for facilitating a moment of mindfulness, awareness, stress reduction and quiet at random times during the day.

The general purpose of the present invention, which will be described subsequently in greater detail, is to provide a new alarm clock system that has many of the advantages of the alarm clocks mentioned heretofore and many novel features that result in a new alarm clock system which is not anticipated, rendered obvious, suggested, or even implied by any of the prior art alarm clocks, either alone or in any combination thereof.

To attain this, the present invention generally comprises an encasement, a display positioned within the encasement, a speaker positioned within the encasement, a plurality of control buttons positioned within the encasement, and a control unit positioned within the encasement and electrically connected to the control buttons, display and the speaker. The user may program the control unit using the control buttons as to the frequency of the random alarms, quite times, sound level of alarm, alarm tones and various other settings.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways such as using software utilized upon a computer, cellular phone, pager and watches. Also, it is to be understood that the phraseology and terminology employed herein are for the purpose of the description and should not be regarded as limiting.

A primary object of the present invention is to provide an alarm clock system that will overcome the shortcomings of the prior art devices.

A second object is to provide an alarm clock system for facilitating a moment of mindfulness, awareness, stress reduction and quiet at random times during the day.

Another object is to provide an alarm clock system that assists in the overall reduction of stress within an individual.

An additional object is to provide an alarm clock system that can be utilized by any individual.

A further object is to provide an alarm clock system that randomly sounds an alarm.

Another object is to provide an alarm clock system that can be programmed as to the total number of times during an interval that the alarm is activated.

A further object is to provide an alarm clock system that can be programmed to have "quiet times" where the alarm is not sounded such as during lunch hours or non-business hours.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
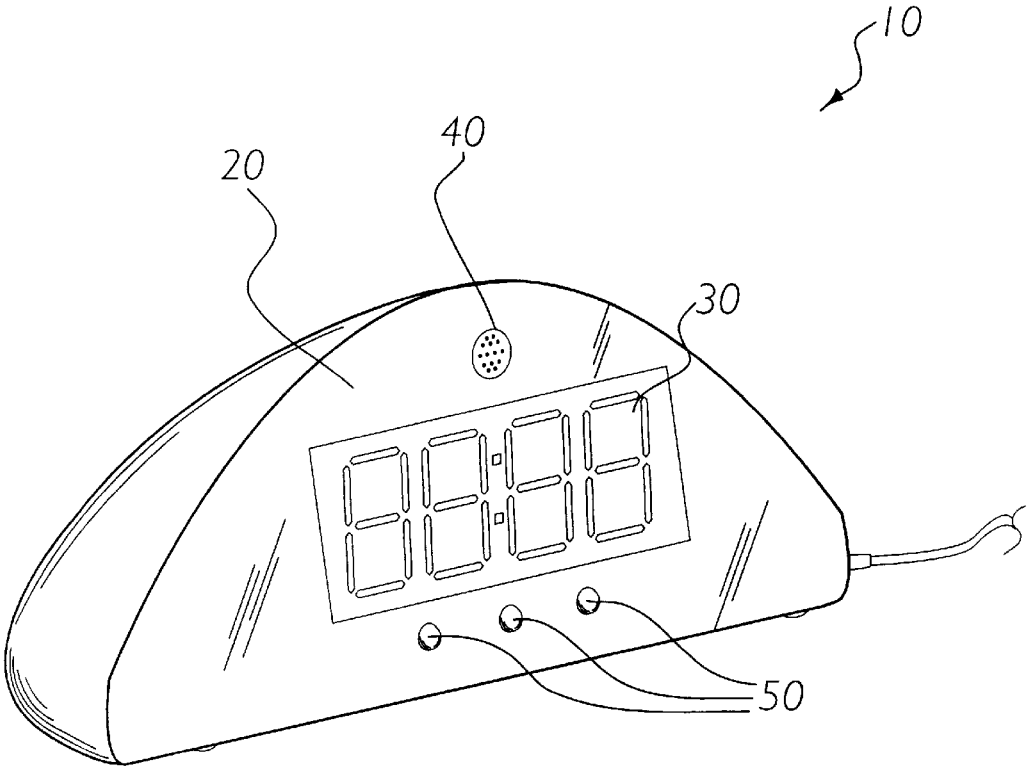
FIG. 1 is an upper perspective view of the present invention.
Figure 2:
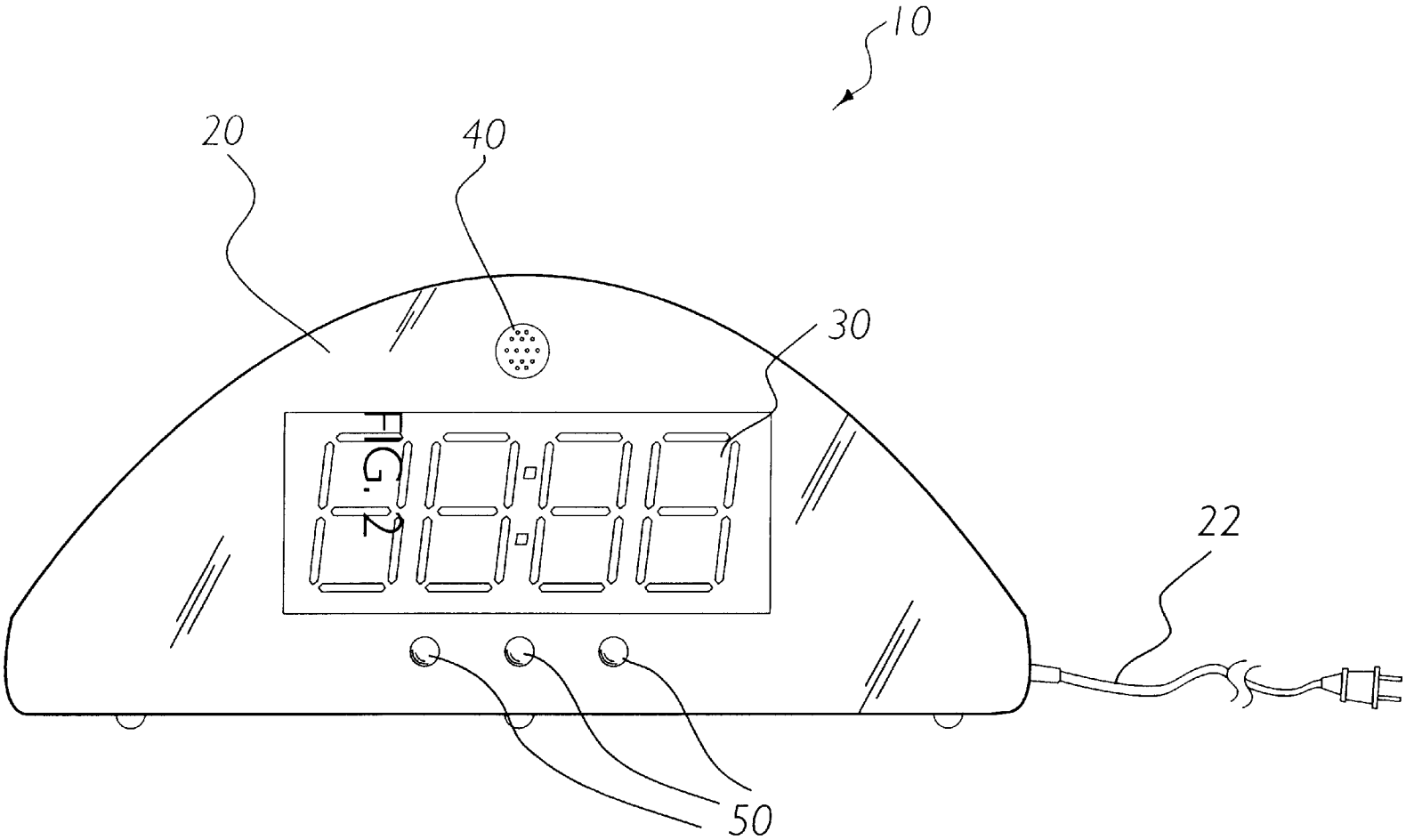
FIG. 2 is front view of the present invention.
Figure 3:
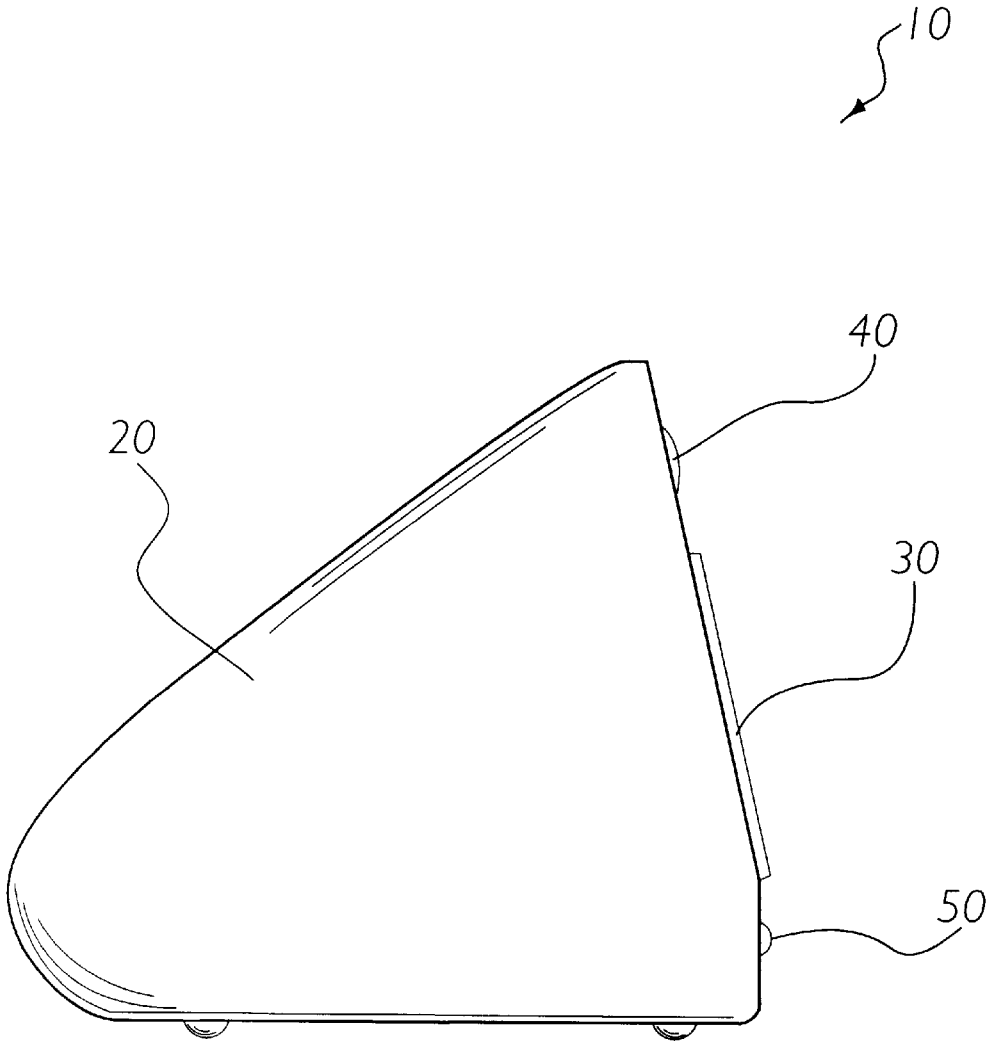
FIG. 3 is a side view of the present invention.

Turning now descriptively to the drawings, in which similar reference characters denote similar elements throughout the several views, FIGS. 1 through 3 illustrate an alarm clock system 10, which comprises an encasement 20, a display 30 positioned within the encasement 20, a speaker 40 positioned within the encasement 20, a plurality of control buttons 50 positioned within the encasement 20, and a control unit 60 positioned within the encasement 20 and electrically connected to the control buttons 50, display 30 and the speaker 40. The user may program the control unit 60 using the control buttons 50 as to the frequency of the random alarms, quite times, sound level of alarm, alarm tone and various other settings.

As shown in FIGS. 1 through 3 of the drawings, the encasement 20 is preferably a rigid structure. The encasement 20 may be comprised of various shapes and designs that are aesthetically pleasing to consumers. The encasement 20 may have various colors or may be transparent. The encasement 20 may also include one or more footings to support the encasement 20 upon a surface such as a table. The encasement 20 may be formed to be utilized upon or within watches, computers, portable computers, hand-held computers, cellular phones, pagers and other electronic devices.

As shown in FIGS. 1 and 2 of the drawings, a display 30 is positioned within a front portion of the encasement 20. The display 30 is constructed of an LCD, LED or other common structure. The display 30 is constructed to display 30 all times of the day in conventional time (am, pm) or military time. The display 30 also is capable of displaying other items commonly found upon a conventional clock.

As shown in FIGS. 1 and 2 of the drawings, a speaker 40 is positioned within the front portion of the encasement 20. The speaker 40 may be positioned within any general location upon the encasement 20 as can be appreciated by one skilled in the art of clocks. The speaker 40 is capable of emitting audible sounds including bell, chime, buzzing, beeping, voices, music or other sounds. It can also be appreciated that a "vibration mode" may be utilized where the encasement 20 is comprised of a portable structure such as a watch, cellular phone, pager or the like so as to be silent to others.

As shown in FIGS. 1 and 2 of the drawings, one or more control buttons 50 are positioned within the front surface of the encasement 20. The control buttons 50 allow the user to program the current time, alarm settings and various other settings. It can be appreciated that more than one speaker 40 may be utilized with the present invention for achieving various results.

Figure 4:
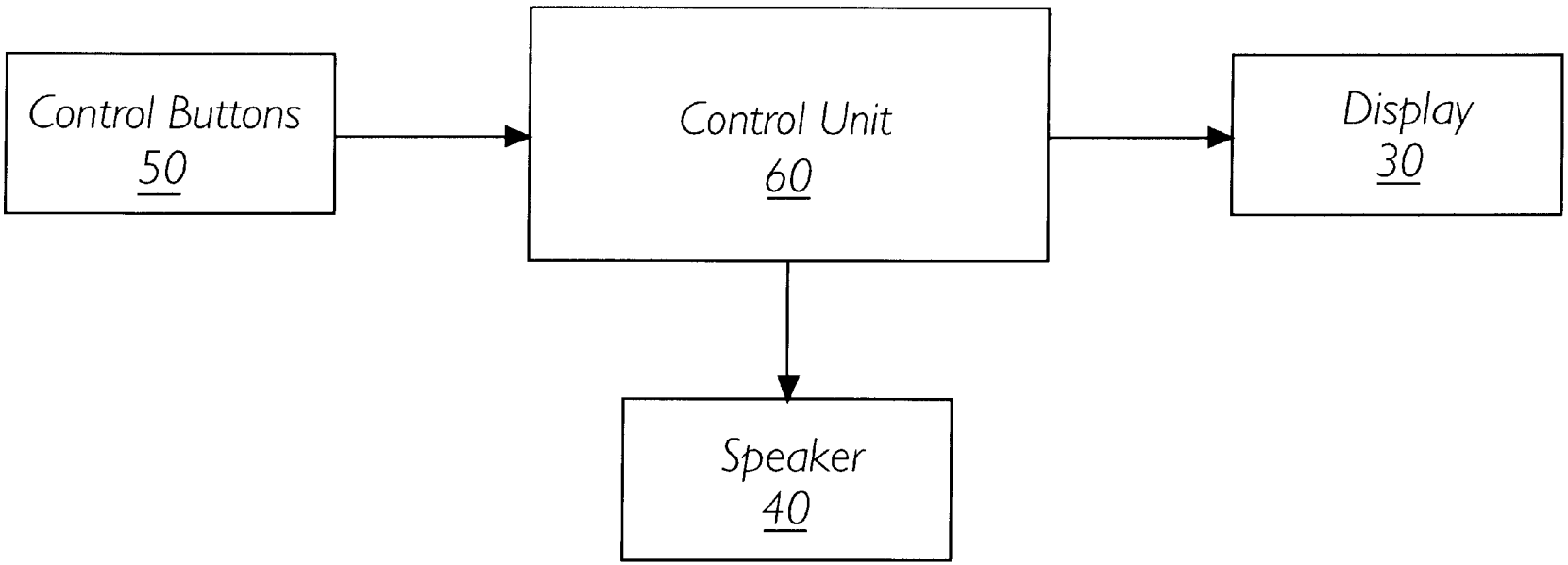
FIG. 4 is a block diagram of the electrical components comprising the present invention.

As shown in FIG. 4 of the drawings, a control unit 60 is electrically connected to the control buttons 50, the speaker 40 and the display 30. The control unit 60 is programmable and capable of storing programmed items such as the current time and alarm settings. The control unit 60 receives electrical power either from a battery source or a power cord 22. The control unit 60 controls the display 30 including the current time and the alarm settings to be displayed to the user. The control unit 60 also control the speaker 40 so that when a random event is selected that the speaker 40 is properly activated. The control buttons 50 allow the user to program the current time and alarm settings into the control unit 60. The control unit 60 is capable of randomly selecting times when to sound the alarm according to the programmed alarm settings.

In use, the user programs the current time into the control unit 60 using the control buttons 50. The user then utilizes the control buttons 50 to program the number of times the alarm is to be sounded during a time interval such as an hour. For example, the user may desire for the random alarms to only be sounded three times per hour during time period A, five times per hour during time period B, and zero times per hour ("quite time") during time period C. It can be appreciated that there can be an unlimited number of time periods that can be programmed into the control unit 60 as desired by the user. The user can also program a conventional alarm time for when they desire to wake up. The conventional alarm time sound emitted by the speaker 40 may be different from the random alarm time sound. When activated, the control unit 60 determines which time period and the corresponding number of random alarms to be executed. The control unit 60 then randomly selects times to emit the random alarm during this time period which creates an awareness in the user. Other time periods, such as lunch periods or non-business hours, the user may program the control unit 60 not to emit any random alarms to reduce disturbing others. It can be appreciated that an alarm device such as a computer may be utilized to recreate the above functionality of the present invention.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An alarm clock system, comprising:

an encasement;

a display positioned within said encasement;

a warning means positioned within said encasement for notifying a user of an alarm time;

a plurality of control buttons positioned within said encasement; and a control unit having an accurate current time, said control unit in communication with said display for displaying only said accurate current time, said warning means and said plurality of control buttons, wherein said control unit is capable of generating a plurality of random alarm times emitted through said warning means.

2. The alarm clock system of claim 1, wherein said random alarm times are controlled by parameters programmed by a user.

3. The alarm clock system of claim 2, wherein said random alarm times are generated a programmed number of times during a time interval.

4. The alarm clock system of claim 3, wherein said time interval is an hour.

5. The alarm clock system of claim 2, wherein said wherein said random alarm times are generated a programmed number of times during a time interval based upon a plurality of time periods.

6. The alarm clock system of claim 5, wherein said plurality of time periods includes at least one time period having no random alarm times.

7. The alarm clock system of claim 1, wherein said control unit may be programmed to sound a wakeup alarm.

8. The alarm clock system of claim 7, wherein said wakeup alarm has a different sound from said random alarms.

9. The alarm clock system of claim 8, wherein said wherein said random alarm times are generated a programmed number of times during a time interval based upon a plurality of time periods.

10. The alarm clock system of claim 9, wherein said plurality of time periods includes at least one time period having no random alarms.

11. An alarm clock system, comprising:

an encasement having a display, a speaker and a plurality of control buttons; and a means for controlling said display and said speaker having an accurate current time positioned within said encasement and in communication with said display for only displaying said accurate current time, said speaker and said plurality of control buttons, wherein said means for controlling is capable of generating a plurality of random alarms emitted through said speaker.

12. The alarm clock system of claim 11, wherein said random alarms are controlled by parameters programmed by a user.

13. The alarm clock system of claim 12, wherein said random alarms are generated a programmed number of times during a time interval.

14. The alarm clock system of claim 13, wherein said time interval is an hour.

15. The alarm clock system of claim 12, wherein said wherein said random alarms are generated a programmed number of times during a time interval based upon a plurality of time periods.

16. The alarm clock system of claim 15, wherein said plurality of time periods includes at least one time period having no random alarms.

17. The alarm clock system of claim 11, wherein said means for controlling may be programmed to sound a wakeup alarm.

18. The alarm clock system of claim 17, wherein said wakeup alarm has a different sound from said random alarms.

19. A method of providing an alarm clock system, comprising the steps of:

(a) providing an alarm device having and only displaying an accurate current time;

(b) receiving program instructions for at least one time period;

(c) generating a plurality of alarms randomly during at least one time period if random alarms are desired during said at least one time period; and (d) repeat step (c) until said at least one time period expires and then repeat step (c) for a next time period.

20. The method of providing an alarm clock system of claim 19, wherein said at least one time period includes at least one time period having no random alarms.

* * * * *